US012031545B2

(12) United States Patent
Vidalenc et al.

(10) Patent No.: US 12,031,545 B2
(45) Date of Patent: Jul. 9, 2024

(54) INTEGRATED MOTOR-COMPRESSOR WITH A STAND-ALONE MOTOR AND BUNDLE

(71) Applicant: NUOVO PIGNONE TECNOLOGIE—S.R.L., Florence (IT)

(72) Inventors: Yoann Vidalenc, Le Creusot (FR); Thomas Alban, Le Creusot (FR); Pascal Gaudez, Le Creusot (FR); Julien Dentan, Le Creusot (FR); Benjamin Defoy, Le Creusot (FR)

(73) Assignee: Nuovo Pignone Tecnologie—S, Florence (IT)

( * ) Notice: Subject to any disclaimer, the term of this patent is extended or adjusted under 35 U.S.C. 154(b) by 193 days.

(21) Appl. No.: 17/595,686

(22) PCT Filed: May 28, 2020

(86) PCT No.: PCT/EP2020/025249
§ 371 (c)(1),
(2) Date: Nov. 22, 2021

(87) PCT Pub. No.: WO2020/239265
PCT Pub. Date: Dec. 3, 2020

(65) Prior Publication Data

US 2022/0220973 A1 Jul. 14, 2022

(30) Foreign Application Priority Data

May 29, 2019 (FR) ..... 1905787

(51) Int. Cl.
*F04D 29/42* (2006.01)
*F04D 17/12* (2006.01)
(Continued)

(52) U.S. Cl.
CPC ..... *F04D 29/4206* (2013.01); *F04D 25/0693* (2013.01); *F04D 29/624* (2013.01);
(Continued)

(58) Field of Classification Search
CPC .. F04D 29/4206; F04D 25/02; F04D 25/0693; F04D 29/624; F04D 17/125; F04D 25/0606; F04D 29/054; F04D 29/603
See application file for complete search history.

(56) References Cited

U.S. PATENT DOCUMENTS 3,934,752 A * 1/1976 Ravicchio ..... F01D 25/265 415/199.1
2004/0179961 A1* 9/2004 Pugnet ..... F04D 25/0606 417/423.5

(Continued)

FOREIGN PATENT DOCUMENTS

GB 647427 A 12/1950
RU 2542657 C2 2/2015
WO 97/23731 A1 7/1997

OTHER PUBLICATIONS

Fasten Definition & Meaning—Merriam-Webster pdf from merriam-webster.com/dictionary/fasten (Year: 2023).*

*Primary Examiner* — Charles G Freay
*Assistant Examiner* — David N Brandt
(74) *Attorney, Agent, or Firm* — Paul Frank + Collins P.C.

(57) ABSTRACT

The bundle compressor to a bundle motor for compressor unit compressor unit includes one at fastening device configured to fasten the compressor bundle to a motor casing of the motor compressor unit, and also includes at least one opening sized to couple a motor rotor and a compressor rotor through the at least one opening.

10 Claims, 5 Drawing Sheets

(51) Int. Cl.

| | |
|---|---|
| ***F04D 25/06*** | (2006.01) |
| ***F04D 29/054*** | (2006.01) |
| ***F04D 29/60*** | (2006.01) |
| ***F04D 29/62*** | (2006.01) |

(52) U.S. Cl.
CPC ..... *F04D 17/125* (2013.01); *F04D 25/0606* (2013.01); *F04D 29/054* (2013.01); *F04D 29/603* (2013.01)

(56) References Cited

U.S. PATENT DOCUMENTS

| | | | | |
|---|---|---|---|---|
| 2006/0024174 | A1 | 2/2006 | Welch | |
| 2007/0172363 | A1* | 7/2007 | Laboube | F16C 37/005 417/370 |
| 2010/0044966 | A1 | 2/2010 | Majot et al. | |
| 2012/0171021 | A1* | 7/2012 | Mariotti | F01D 25/16 415/170.1 |
| 2012/0171052 | A1 | 7/2012 | Giachetti | |
| 2017/0254341 | A1* | 9/2017 | Bertoneri | F01D 11/02 |

* cited by examiner

[FIG. 1]
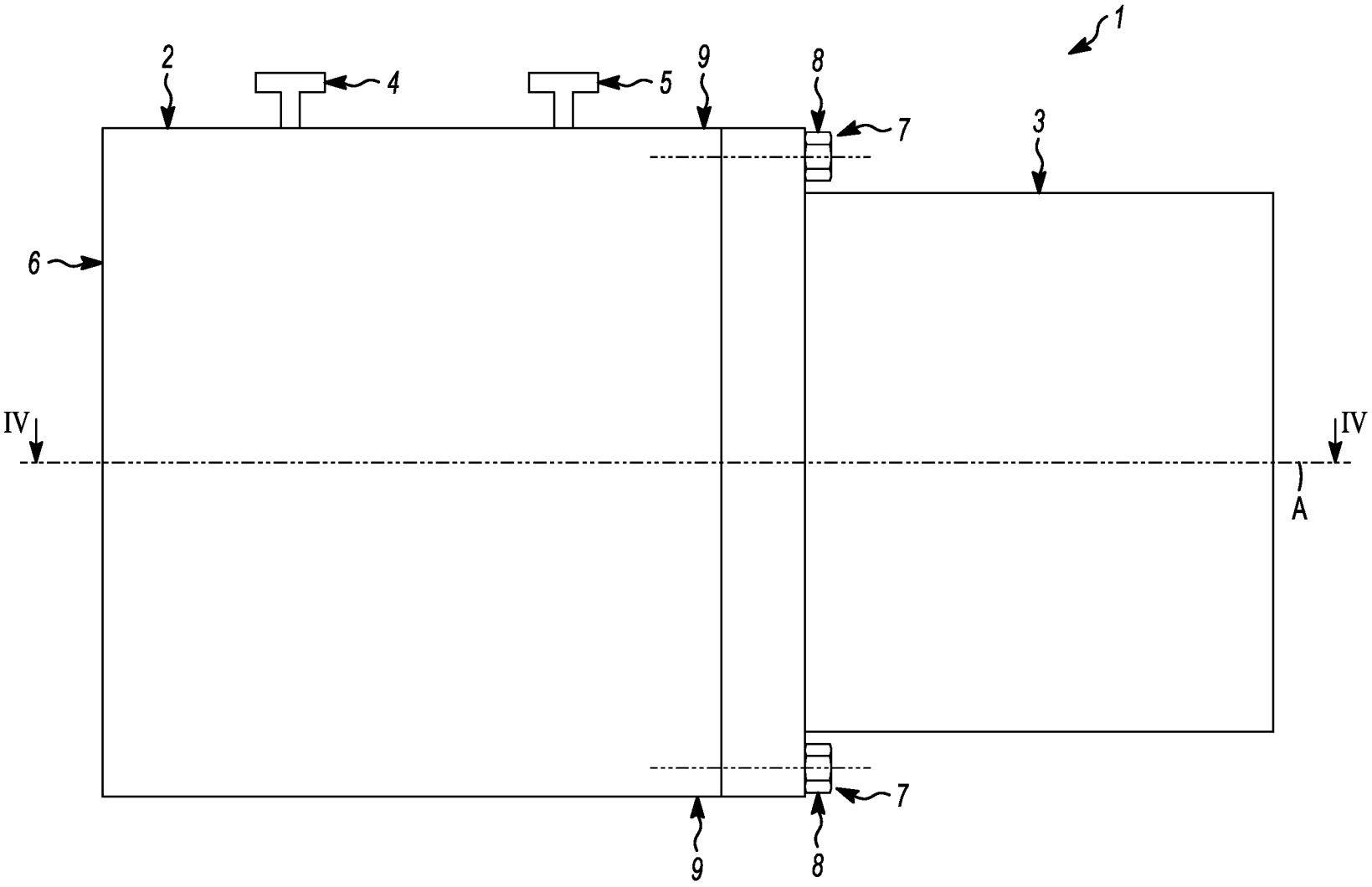

[FIG. 2]
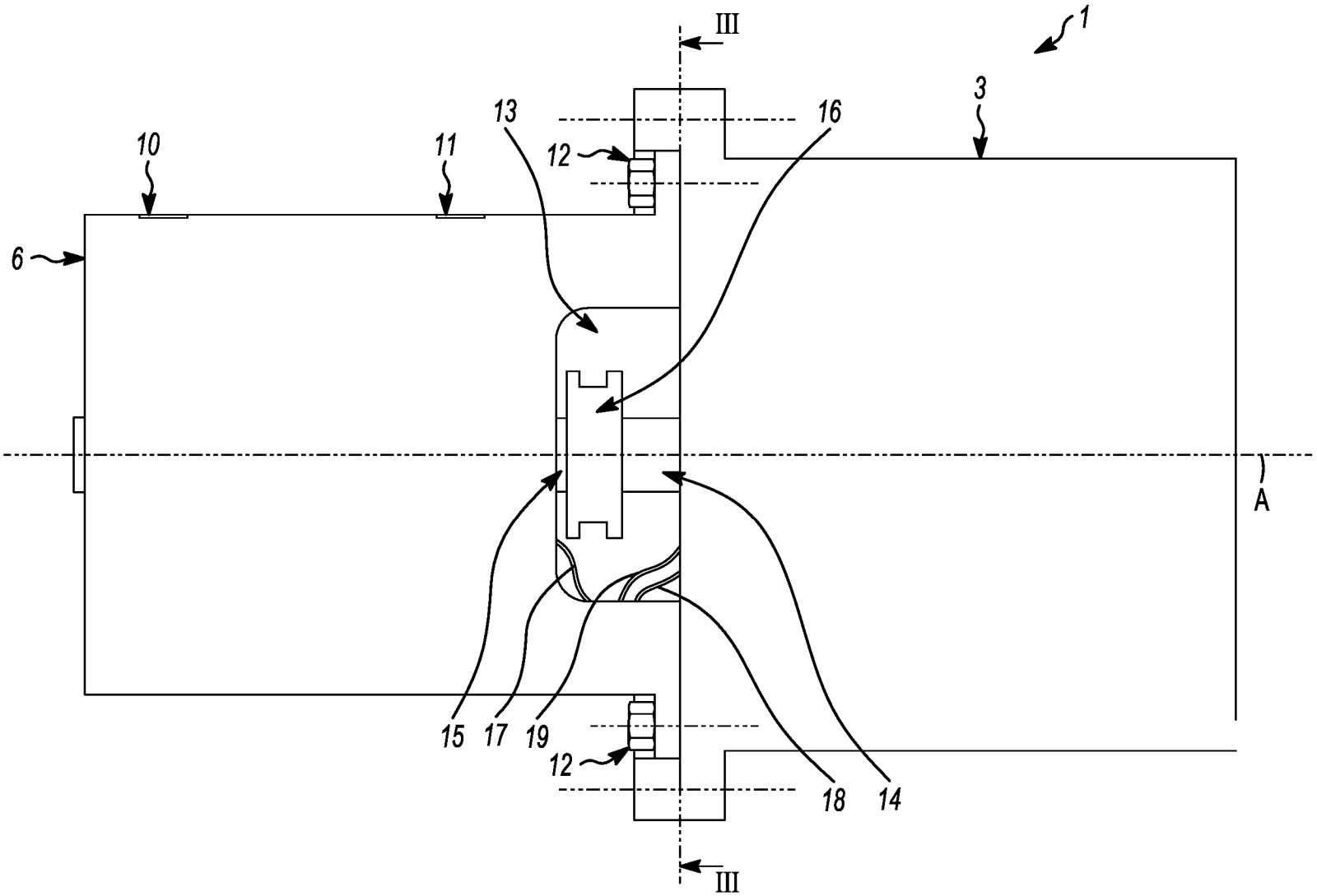

[FIG. 3]
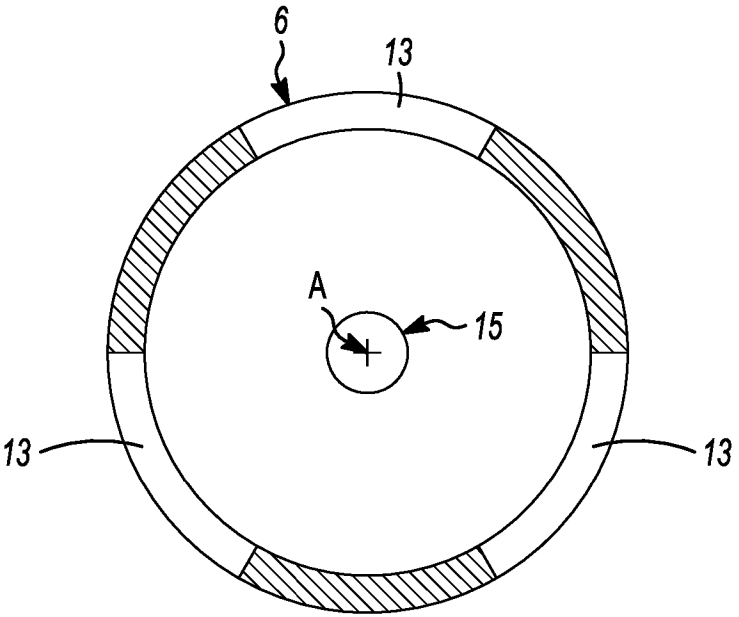

[FIG. 4]
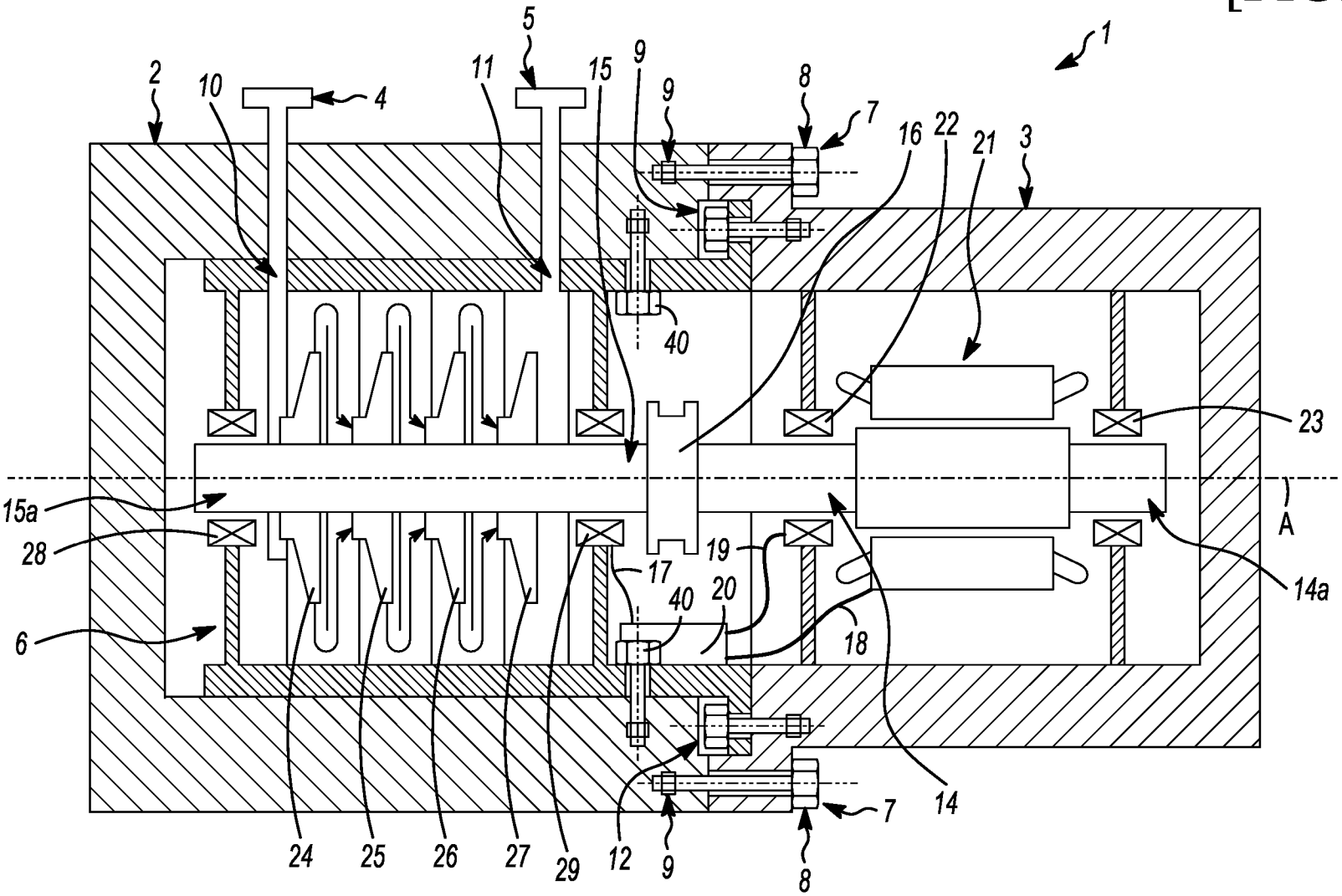

[FIG. 5]
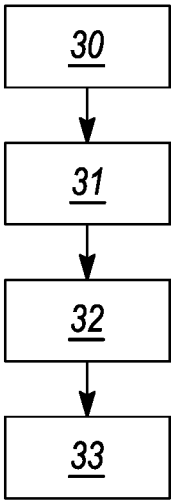

INTEGRATED MOTOR-COMPRESSOR WITH A STAND-ALONE MOTOR AND BUNDLE

Embodiments of the invention relate generally to motor compressor units, and more particularly to a coupling of a compressor bundle and a motor casing of an integrated in line compressor ("ICL").

Embodiments of the invention also relate to a method for assembling such a motor compressor unit.

Generally, a motor compressor unit comprises a compressor bundle mounted in a cylindrical compressor casing and a cylindrical motor casing.

To assemble the motor compressor unit, the compressor casing and the motor casing are fastened together forming a housing sealed tight against a gas to be compressed.

Then, a coupling device is mounted into the housing to connect a motor shaft and a shaft of the compressor bundle together.

As the two casings are fastened together, generally at least one small access port is provided in the compressor casing, this port being sized so that an operator is able to connect each shaft to the coupling device through the access port, and sized to resist to high pressures arising in the ICL housing.

After coupling of the two shafts, the access port is hermetically closed with a hatch so that the compressed gas cannot leak outside the compressor casing.

The hatch is massive to resist to high pressures.

The access port is also used for maintenance access.

One common used solution to staunch the hatch is to provide the compressor casing with a plane, the access port been localized on the plane so that the hatch sealing joints are planar.

However, creating a plane on a cylinder reduces the compressor casing volume.

For compressor units comprising a compressor casing with a small external diameter, the size of the access port may be not large enough to perform the coupling of the two shafts through the access port.

The document US 2010/0044966 discloses a motor compressor unit comprising a compressor casing and a motor casing connected together with a coupling including access ports.

The motor compressor unit further comprises a coupling guard comprising sealing members and mounted on two slide guides so that the coupling guard translates and forms a sealing surface over the coupling.

However, the coupling guard and slide guides are massive and voluminous parts.

Moreover, the translation of the coupling guard deteriorates the sealing members scraping on the motor casing.

There is a need to avoid at least some of the previously-mentioned drawbacks, especially by suppressing hatches closing access ports or coupling.

According to an aspect, a compressor bundle for a motor compressor unit is proposed.

The compressor bundle may include at least one fastening device configured to fasten the compressor bundle to a motor casing of the motor compressor unit, and may also include at least one opening sized to couple of a motor rotor and a compressor rotor through the at least one opening.

According to another aspect, a motor compressor unit is proposed.

The motor compressor unit may comprise:

a compressor bundle as defined above; and a motor casing, the at least one fastening device fastening the compressor bundle and the motor casing together.

Advantageously, the at least one fastening device is at least one removable fastening device.

The motor compressor unit may further comprise a compressor casing, the compressor bundle being mounted in the compressor casing fastened to the motor casing, the motor casing and the compressor casing forming a housing sealed with respect to a gas to be compressed.

Advantageously, the compressor bundle is fastened in the compressor casing by at least one removable fastening device.

According to an aspect, a method for assembling a motor compressor unit is proposed.

The method may comprise:

fastening a compressor bundle to a motor casing; and coupling through at least one opening of the compressor bundle a motor rotor and a compressor bundle rotor.

A coupling device may be connected to one of the motor rotor and the compressor rotor, the coupling step comprises connecting the coupling device to the other rotor.

The method further may further comprise:

inserting the compressor bundle into a compressor casing; and fastening the compressor bundle in the compressor casing, the motor casing and the compressor casing forming an housing sealed with respect to a gas to be compressed.

The compressor bundle and the motor casing may be fastened together by at least one removable fastening device.

The compressor bundle may further be fastened in the compressor casing by at least one removable fastening device.

The method may further comprise performing at least one electrical or mechanical connection through the at least one opening.

Other advantages and features of the invention will appear on examination of the detailed description of embodiments, in no way restrictive, and the appended drawings in which:

FIG. 1 represents an embodiment of a motor compressor unit;

FIG. 2 illustrates the motor compressor unit without the compressor casing;

FIG. 3 illustrates a view of the compressor bundle;

FIG. 4 illustrates a longitudinal cross section of the motor compressor unit; and FIG. 5 illustrates an example of a method for assembling the motor compressor unit.

Embodiments herein disclosed are intend to fasten a compressor bundle unit and a motor casing in such a way that the connection of a motor rotor and a compressor bundle rotor is performed before the compressor bundle unit is inserted into a compressor casing, the motor casing compressing the compressor bundle unit and the motor casing forming the motor compressor.

Access ports and hatches usually used to connect the motor rotor and the compressor bundle rotor are suppressed reducing the weight of the motor compressor unit, enhancing the sealing integrity of the motor compressor housing and avoiding that the volume inside the housing is reduce.

Furthermore, using removable fastening devices to fasten the compressor bundle to the compressor casing and to fasten the motor casing to the compressor casing allows to easily extract the compressor bundle from the compressing casing.

In addition, using removable fastening devices to fasten the compressor bundle to the motor casing allows to easily dismount the compressor bundle and the motor casing when the compressor bundle lies outside the compressor casing.

Reference is made to FIG. 1 which represents an embodiment of a motor compressor unit 1 comprising a compressor casing 2, a motor casing 3 and a central axis A confused with an axis of rotation of the motor compressor unit.

The casings 2 and 3 are cylindrical.

In another embodiment, the casings 2 and 3 may have another shape, for example square.

The compressor casing 2 may include a first 4 flange and a second 5 flange, that are configured to be connected to gas processing means (not represented).

Illustratively, FIG. 1 depicts first flange 4 connected with a gas inlet pipe and the second flange 5 connected with a gas outlet pipe.

The gas inlet pipe provides a gas to be compressed by the motor compressor unit 1.

The flanges 4 and 5 are arranged perpendicularly to the central axis A.

In another embodiment, the compressor casing 2 may have more than two flanges, for example the compressor casing 2 may have one input flange and two output flanges.

A compressor bundle 6 is mounted in the compressor casing 2.

The compressor bundle 6 may be fastened in the compressor casing 2 by at least one first removable fastening device 40, for example screw and thread assemblies so that the compressor bundle 6 can be easily dismounted from the compressor casing 2.

In another embodiment, the compressor bundle 6 is fastened in the compressor casing 2 without using a removable fastening device. For example, the two casings may be welded together.

Second fastening devices 7 fasten the compressor casing 2 and a motor casing 3 together.

The second fastening devices 7 are for example removable fastening devices comprising screws 8 mounted in threads 9 localized in the compressor casing 2.

The motor casing and the compressor casing form a housing sealed tight with respect to the gas to be compressed.

FIG. 2 illustrates the motor compressor unit 1 when the compressor casing 2 is dismounted.

The compressor bundle 6 further comprises a compressor bundle inlet 10 and a compressor bundle outlet 11 respectively cooperating with the first flange 4 and the second flange 5 so that gas flows through the compressor bundle 6.

Third fastening devices 12 fasten the motor casing 3 and the compressor bundle 6 together.

The third fastening devices 12 are removable fastening devices comprising for example screw and thread assemblies.

In another embodiment, the third fastening devices 12 do not comprise removable fastening means. For example, the motor casing 3 and the compressor bundle 6 are welded together.

The compressor bundle further comprises openings 13 sized for carry out the coupling of a motor rotor 14 of the motor casing 3 and a compressor rotor 15 of the compressor bundle 6 through the openings 13.

A coupling device 16 connects the two rotors 14 and 15 together.

The coupling device 16 may be a flexible coupling device to decouple the two rotors 14 and 15.

The openings 13 are further used to perform electrical or mechanical connections through the openings 11, for example coupling wires 17, 18 and 19 to a control circuit 20 (represented on FIG. 4).

FIG. 3 illustrates a view of the compressor bundle 6 according the direction III-III of FIG. 2.

The compressor bundle 6 comprises three openings 13 regularly arranged on an outer periphery of the compressor bundle 6.

According to another embodiment, the compressor bundle 6 comprises at least one opening or more openings arranged irregularly on an outer periphery of the compressor bundle 6, the openings having a same shape or different shapes.

FIG. 4 illustrates a longitudinal cross section of the motor compressor unit 1.

The motor casing 3 comprises a motor 21 comprising the rotor 14.

The motor 21 may be an electric motor such as a permanent magnet motor having permanent magnets mounted on the rotor and a stator. As an alternative, other types of electric motors, such as for example synchronous, induction, brushed DC motors may be used.

Wire 18 connects the motor 21 to the control circuit 20.

The motor rotor 14 comprises a motor shaft 14*a* rotationally supported in the motor casing 3 by two bearings 22, 23.

The compressor bundle 6 comprises one compression section comprising four compression wheels 24, 25, 26, 27 mounted on a compressor shaft 15*a*, the compression wheels and compressor shaft 15*a* forming the rotor 15.

The compressor shaft 15*a* is rotationally supported in the compressor bundle 6 by two bearings 28, 29.

Bearings 22, 23, 28 and 29 are active magnetic bearings, the bearings 22 and 23 been connected to the control circuit 20 by the wire 19 and the bearings 28 and 29 been connected to the control circuit 20 by the wire 17.

The control circuit 20 is configured to control the bearings 22, 23, 28 and 29, and the motor 21. The control circuit 20 comprises for example a microprocessor.

Alternatively, the bearings 22, 23, 28 and 29 may be hydrodynamic bearings.

In another embodiment, the compressor bundle 6 may comprise more than one compression section, each section comprising at least one compression wheel.

In another embodiment, the motor casing 3 and the compressor bundle 6 comprise more or less than two bearings.

Referring now to FIGS. 1, 2, 3, and 4, a complete operating cycle of the compressor is described.

In an embodiment of operation of the motor-compressor unit 1, the motor 21 rotates the motor rotor 14 and thereby drives the compressor shaft 15*a*. A process gas to be compressed is introduced via the first flange 4 provided in the compressor housing 2. The motor compressor unit 1 then compresses the process gas through the compression wheels 24, 25, 26, 27 to thereby produce a compressed process gas. The compressed process gas then exits the motor compressor unit 1 via the second flange 5 provided in the compressor housing 2.

FIG. 5 illustrates an example of a method for assembling the motor compressor unit 1.

It is assumed that a first end of the coupling device 16 is connected to the motor shaft 14*a* and that one end of the wires 18, 17 and 19 is connected to the motor 21, to the bearings 22 and 23, and to the bearings 28 and 29.

At step 30, the motor casing 3 and the compressor bundle 6 are fastened together using the third fastening devices 12.

Then, at step 31, the motor rotor 14 and the compressor rotor 15 are coupled together. The second end of the coupling device 16 is connected to the compressor shaft 15*a*, a central axis of the axis 14 and 15 been aligned on the central axis A of the motor compressor unit 1.

The coupling is performed through the openings 13.

Further, the free end of the wires 17, 18 and 19 is connected to the control circuit 20. The connection of the wires 17, 18 and 19 is performed through the openings 13.

Other electrical connections can be performed through the openings, for example connecting sensors to the control circuit 20. Mechanical connections can also be performed through the openings 13 at step 32.

Then, in a stage 32, the compressing bundle 6 fastened to the motor casing 3 is inserted into the compressor casing 2 and fastened in the compressor casing 2 by the first fastening device 40.

The compressor casing 2 and motor casing 3 are then fastened together by the second fastening devices 7 (step 33).

Fastening the compressor bundle 6 to the motor casing 3, and providing the compressor bundle 6 with at least one opening 13 enable to couple the motor rotor 14 and compressor rotor 15, and to perform electrical or mechanical connections without using access ports and hatches.

The suppression of access ports and hatches reduces the weight of the motor compressor 1 and enhances the sealing integrity of the motor compressor housing.

In addition, the volume inside the housing is not reduced, no plane surface is required on the housing.

It is very well adapted for motor compressor with small external diameter.

Furthermore, the use of first 40 and second 7 removable fastenings devices allows to easily extract the compressor bundle 6 from the compressing casing 2, for example for maintenance operations, without dismounting the first and second flanges 4, 5 arranged perpendicularly to the central axis A of the motor compressor 1.

In addition, the use of third removable fastening devices 12 enables to easily dismount the compressor bundle 6 and the motor casing 3 when the compressor bundle 6 lies outside the compressor casing 4 to ease maintenance operations.

Various inventive aspects of the invention are set forth in the following clauses, which may be combined in any suitable fashion unless otherwise indicated:

A. Compressor bundle (6) for a motor compressor unit (1), the compressor bundle includes at least one fastening device (12) configured to fasten the compressor bundle to a motor casing (3) of the motor compressor unit, and also includes at least one opening (13) sized to couple a motor rotor (14) and a compressor rotor (15) through the at least one opening.

B. Motor compressor unit (1) comprising:
a compressor bundle (6) according to A; and
a motor casing (3), the at least one fastening device (12) fastening the compressor bundle and the motor casing together.

C. Motor compressor unit according to B, in which the at least one fastening device (12) is at least one removable fastening device.

D. Motor compressor unit according to B or C, further comprising a compressor casing (2), the compressor bundle (6) being mounted in the compressor casing fastened to the motor casing, the motor casing and the compressor casing forming a housing sealed with respect to a gas to be compressed.

E. Motor compressor unit according to D, in which the compressor bundle (6) is fastened in the compressor casing (2) by at least one removable fastening device (40).

F. Method for assembling a motor compressor unit (1), the method comprises:
fastening a compressor bundle (6) to a motor casing (3); and
coupling through at least one opening (13) of the compressor bundle a motor rotor (14) and a compressor bundle rotor (15).

G. Method according to F, in which a coupling device (16) is connected to one of the motor rotor (14) and the compressor rotor (15), the coupling step comprising connecting the coupling device to the other rotor.

H. Method according to F or G, further comprising:
inserting the compressor bundle (6) into a compressor casing (2); and
fastening the compressor bundle in the compressor casing, the motor casing (3) and the compressor casing forming an housing sealed with respect to a gas to be compressed.

I. Method according to any one of F, G or H, in which the compressor bundle (6) and the motor casing (3) are fastened together by at least one removable fastening device (12).

J. Method according to any one of F, G, H or I, in which the compressor bundle (6) is fastened in the compressor casing (2) by at least one removable fastening device (40).

K. Method according to any one of F, G, H, I or J, further comprising performing at least one electrical or mechanical connection through the at least one opening (13).

The invention claimed is:

1. A motor compressor unit, comprising: a motor casing; a compressor casing attached to the motor casing; a compressor bundle that resides inside of the compressor casing and attaches to the motor casing and the compressor casing; and a plurality of fastened locations comprising a first fastened location at which the compressor bundle couples to the compressor casing in a first direction that is perpendicular to the longitudinal axis, a second fastened location at which the compressor casing couples to the motor casing in a second direction that is parallel to the longitudinal axis, and a third fastened location at which the compressor bundle couples to the motor casing in the second direction, wherein the compressor bundle includes an opening sized to couple a motor rotor and a compressor rotor through the at least one opening, and wherein one of the plurality of fastened locations comprises a weld.

2. The motor compressor unit according to claim 1, wherein one of the first fastened location, the second fastened location, or the third fastened location comprises a removable screw.

3. The motor compressor unit according to claim 1, wherein the motor casing and the compressor casing form a housing sealed with respect to a gas to be compressed.

4. The motor compressor unit according to claim 1, wherein the first fastened location comprises a removable screw.

5. The motor compressor unit according to claim 1, wherein the third fastened location comprises a weld.

6. A method for assembling a motor compressor unit, comprising: fastening a compressor bundle to a motor casing at a plurality of fastened locations, the plurality of fastened locations comprising a first fastened location at which the compressor bundle couples to the compressor casing in a first direction that is perpendicular to the longitudinal axis, a second fastened location at which the compressor casing couples to the motor casing in a second direction that is parallel to the longitudinal axis, and a third fastened location at which the compressor bundle couples to the motor casing in the second direction; and coupling through at least one opening of the compressor bundle a motor rotor and a compressor bundle rotor, wherein the compressor bundle and the motor casino are fastened together by at least one first removeable screw, the at least one removeable screw located at the third fastened location.

7. The method according to claim 6, further comprising:

connecting a coupling to each of the motor rotor and the compressor bundle rotor.

8. The method according to claim 6, further comprising:

inserting the compressor bundle into a compressor casing; and fastening the compressor bundle in the compressor casing, the motor casing, and the compressor casing forming a housing sealed with respect to a gas to be compressed.

9. The method according to claim 6, wherein the compressor bundle is fastened in the compressor casing by at least one second removable screw.

10. The method according to claim 6, further comprising:

performing at least one electrical or mechanical connection through the at least one opening.

* * * * *